United States Patent [19]

Simon

[11] 4,150,683

[45] Apr. 24, 1979

[54] ELIMINATION OF OVERFLOW OF SEWER SYSTEMS

[76] Inventor: Wilbur Simon, 164 Division St. P.O. Box 58, Elgin, Ill. 60120

[21] Appl. No.: 826,765

[22] Filed: Aug. 22, 1977

[51] Int. Cl.[2] ..... E03F 3/00

[52] U.S. Cl. ..... 137/1; 137/236 R

[58] Field of Search ..... 137/1, 2, 236, 363; 61/10, 11

[56] References Cited

U.S. PATENT DOCUMENTS

| | | | |
|---|---|---|---|
| 2,012,495 | 8/1935 | Bradbeer | 137/236 X |
| 2,947,321 | 8/1960 | Kovaleik | 137/236 X |
| 3,428,077 | 2/1969 | Scarfe | 137/313 |
| 3,805,817 | 4/1974 | Smith | 137/236 |

*Primary Examiner*—Alan Cohan

[57] ABSTRACT

A system for the elimination of overflow and back-up of sewers. A technique is provided for controlling flow of surface water in a combined sewer system, separate storm sewer, or the like, by regulating water flow into the system lateral lines from individual catch basins. In addition, apparatus is taught for practicing such technique.

12 Claims, 10 Drawing Figures

Fig. 1
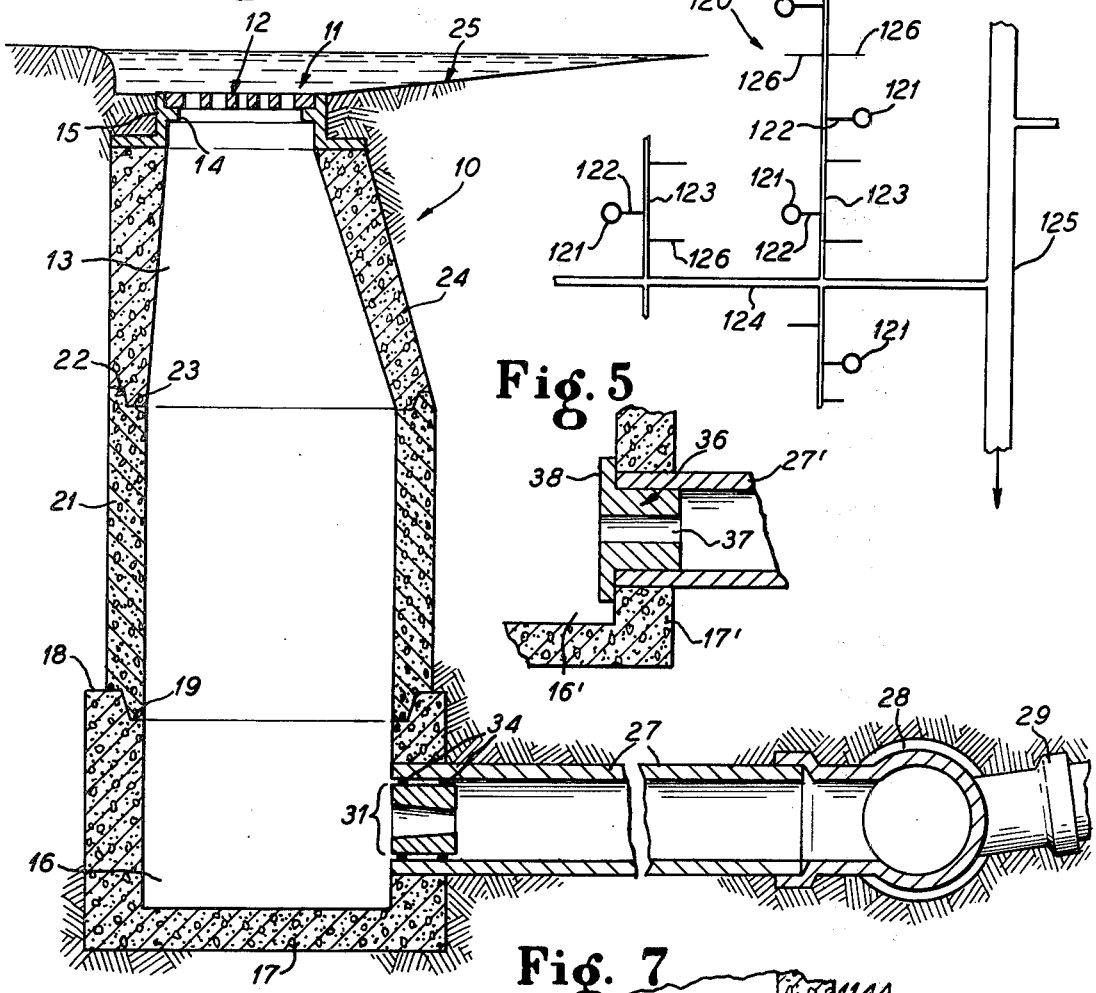
Fig. 10
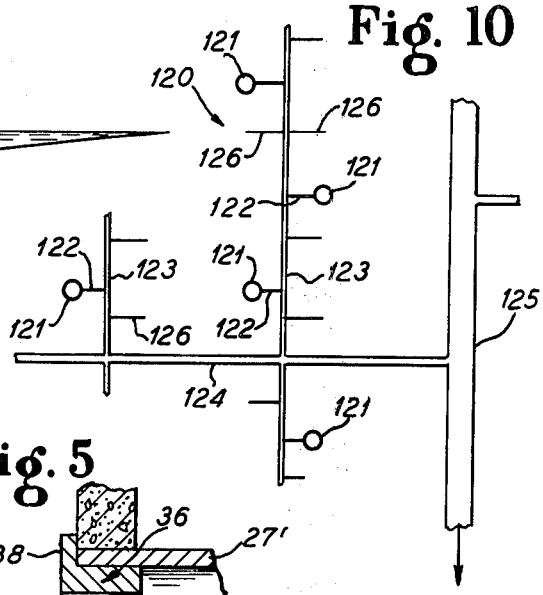
Fig. 5
Fig. 7
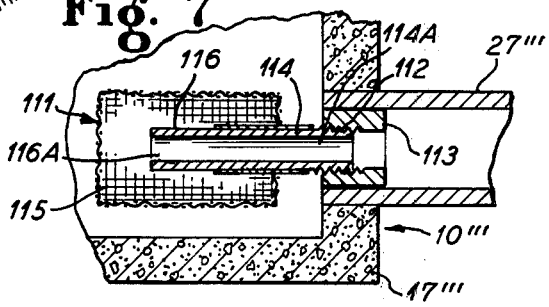
Fig. 2
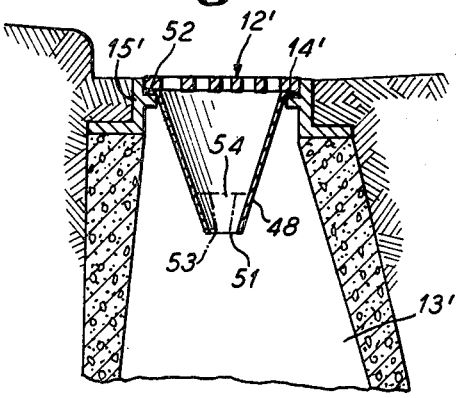
Fig. 6
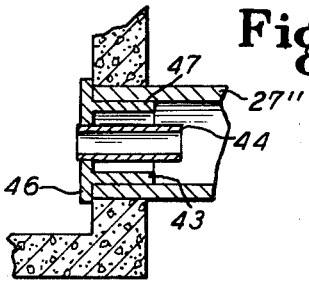

ELIMINATION OF OVERFLOW OF SEWER SYSTEMS

BACKGROUND OF THE INVENTION

Most sewer systems have three major problems: (1) the back up of sanitary sewers into basements; (2) the back up of storm sewers into streets and onto tree banks and sidewalks; and (3) the overflow and diversion of sewage into streams and lakes. In communities which have separate storm and sanitary sewers, all of these problems except the flooding of streets can be solved by complete enforcement of laws prohibiting the connection of down spouts, foot drains, and sump pumps to be sanitary sewer.

Until Jan. 1, 1977, it was legal to divert overflow of wastes into streams and lakes. Only in the past ten years has it been necessary to concentrate on the solution of overflow and diversion problems.

The three major methods which up to the present time have been instituted, studied or proposed are: (1) the separation of storm sewers from sanitary sewers; (2) the storage of overflow for periods of low flow; and (3) the treatment of overflow so that it is safe to discharge into lakes or streams. The first method will accomplish the elimination of the overflow of interceptor sewers, but will not solve the street flooding problem caused by back up of storm sewers. In additon, the cost is prohibitive.

Method two will solve the overflow problem in combined sewer systems if the sewage treatment plant has the capacity to handle the overflow during periods of low flow. In addition, if the size of the storage facility is determined from overflow data which is extrapolated to the heaviest rainfall expected, it is subject to serious errors. The only accurate method of calculating maximum overflow due to surface water is to measure the size of the outlet of a catch basin and multiply the amount of water that it will carry by the number of catch basins feeding the interceptor sewer. This method is expensive, but not as expensive as separating sewers. In addition to its high cost, it will not solve the problem of street flooding or the back up of sewage into streets. Neither will it prevent basement flooding through sanitary sewers.

Method three will be less expensive than method two if a more efficient treatment of the waste is divised. Otherwise, it suffers the same drawbacks as method two. The elimination of overflow and backup of sewers by alteration of catch basin outlets appears never to have been previously considered, as is demonstrated by the following considerations: The government has lowered its standards for sewage treatment plant effluent because the only methods considered are storage and separation procedures. The separation procedure is out of the question because it is too expensive. The estimated cost of accomplished separation in existing combined sewer systems is estimated to be over $200,000,000,000 in the United States. Overflow measured directly and extrapolated to the largest storm in 100 years indicates that sewage plants are too small to handle the stored wastes even in periods of low flow. Also, the direct measurement of overflow would not be considered, nor would the 100 year storm be considered, if sewer system consultants were aware that any method or means were available for use in solving their measurement problems. No publications are now known relating to elimination of overflow and back up from sewers filled therefrom, and no publications are now known relating to control of flow from catch basins into sewer systems.

So far as is known to me, inexpensive effective techniques and means for overcoming the above indicated problems in combined sewer systems have not heretofore existed. Solution of these problems by my technique would be desirable not only from the standpoint of improving and overcoming faults with existing sewers, but also from the standpoint of making possible in the future further utilization of combined sewers in new construction situations which would avoid the inherently higher costs associated with separate storm sewers and sanitary sewers.

BRIEF SUMMARY OF THE INVENTION

In one aspect, the present invention provides a technique for eliminating the overflow of combined sewers by adjusting the quantities of water which can flow into the interceptor sewer. This adjustment is achieved in such combined sewers through the regulation of the size of the interconnecting pipe between each catch basin and the lateral line.

In another aspect, this invention provides apparatus adapted for the practice of such technique.

The primary object of the present invention is to provide a technique capable of eliminating the overflow of combined sewers.

Another object is to provide a technique of the class described which can be practiced with an existing combined sewer system with a minimum of changes or additions.

Another object of this invention is to provide apparatus for such a technique which apparatus is adapted to change the effective pipe size, the size of the catch basin inlet or in a combined sewer system.

Another object of the present invention is to provide a method and means for reducing street flooding during a storm in a district served by a combined sewer system, and, furthermore, after a storm has subsided, to provide a method and means for eliminating flooding tending to occur at individual catch basins feeding such combined sewers.

Another object of the present invention is to provide a technique of the class indicated to which is simple both in theory and in practice.

Another object is to provide a technique for eliminating the back up of sanitary sewers into basements.

Another object is to provide a technique to prevent the flooding of streets, tree banks, and sidewalks by the back up from storm sewers or combined sewers.

Another object is to provide a technique for the proper design of new storm sewer systems whether the storm sewers empty into a river, lake, reservoir, or a sanitary sewer.

Another object is to provide a technique of the class indicated which is so inexpensive that cities and sanitary districts which are now facing rain water flow problems and pollution problems can solve such without government aid and without a significant increase in taxes. Another object is to reduce the cost of solving the problem by existing methods.

Another object is to provide a low cost technique capable of eliminating the overflow from combined sewers.

In one aspect, this invention provides a technique for eliminating the overflow of combined sewers by controlling the amount of surface water which can flow into interceptor sewers. This control is achieved in such combined sewers by regulating the size of the pipe connecting catch basins with lateral lines:

In another aspect, this invention provides a technique for eliminating the flooding of streets tree banks and sidewalks by storm sewers and catch basins.

In another aspect, this invention prevents the flooding of basements caused by back up of combined sewers.

In another aspect, this invention provides a technique for designing new storm sewer systems which will not back up and overflow.

In another aspect, this invention provides a method for making more flexible existing storage or treatment facilities for combined sewer overflow.

In another aspect, this invention reduces the cost of preliminary studies for the design of storage or treatment facilities.

Other and further objects, purposes, advantages, aims, utilities, features, aspects, and the like will be apparent to those skilled in the art from a reading of the present specification taken together with the drawings.

BRIEF DESCRIPTION OF DRAWINGS

In the drawings:

FIG. 1 is a vertical sectional view taken through the region of a catch basin, including the feeder pipe therefor joining the catch basin with a lateral line of a combined sewer system illustrating one embodiment of a flow rate limiting arrangement of the present invention;

FIG. 2 is a fragmentary, enlarged detail view of a catch basin similar to that shown in FIG. 1, but illustrating another embodiment of a flow rate limiting arrangement employed in the practice of the present invention;

FIG. 5 is a fragmentary view of the mouth region of the outlet pipe arrangement shown in FIG. 1 but illustrating another embodiment of a flow rate limiting arrangement employable in the practice of the present invention.

FIG. 6 is a view similar to FIG. 5, but showing yet another embodiment of a flow rate limiting arrangement employable in the practice of the present invention;

FIG. 7 is a view similar to FIG. 5, but showing a further embodiment of a flow rate limiting arrangement employable in the practice of the present invention which is additionally provided with a screen;

FIG. 10 shows diagramatically an arrangement of catch basins and interconnecting pipes in a combined sewer system.

DETAILED DESCRIPTION

Figure 3:
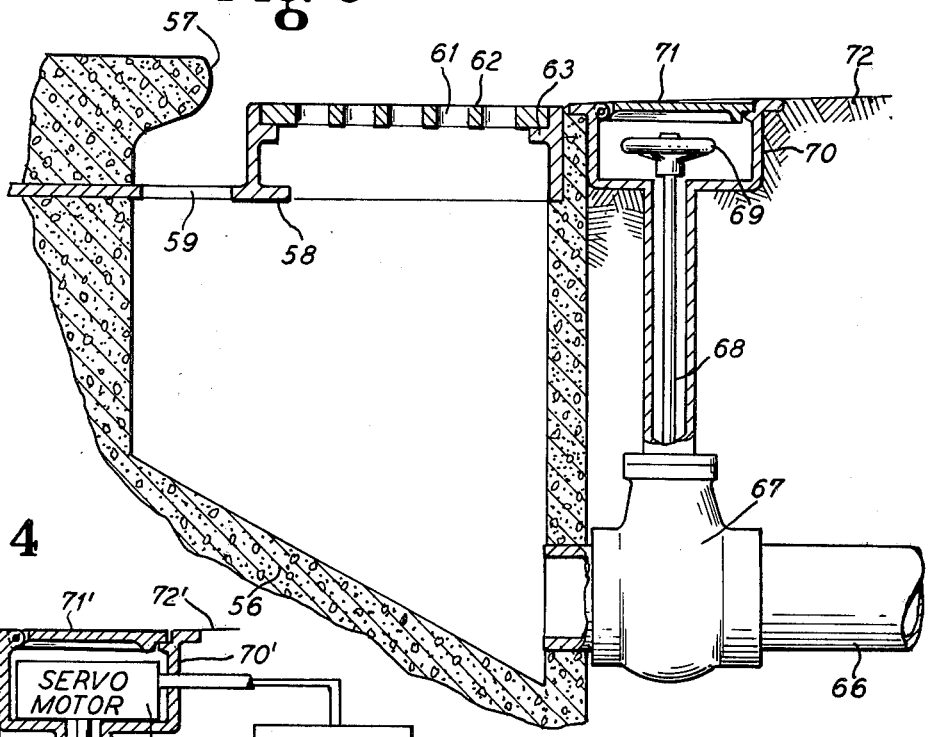
FIG. 3 shows in vertical sectional view taken through the region of another type of catch basin which is provided with a further embodiment of a flow rate limiting arrangement employable in the practice of the present invention.

In the specification and claims, the following definitions are used:

Catch Basin—A cistern located at the point where a street gutter discharges into a sewer and designed to catch and retain matter that would not pass easily through the sewer. Also, a reservoir or well into which surface water may drain off.

Combined sewer—A sewer into which both surface water and waste water are drained.

Manhole—A hole through which a man may go especially to gain access (as for cleaning and repair) to underground or enclosed structure (as a sewer, electric conduit or steam boiler.)

Trunk line—A large sewer line into which a number of lateral lines drain.

Lateral line—A sewer line into which sewage from individual housing units drain. In a combined sewer system surface water enters lateral lines from catch basins.

Interceptor sewer or interceptor—The largest sewer line in a sewer system. It drains two or more trunk lines, and in turn, this sewer goes directly into the sewage treatment plant. The interceptor sewers have overflows. No catch basins are attached directly to an interceptor sewer line.

Storm sewer—A sewer that carries surface water, only, to a lake or stream or to a water treatment plant.

Box screen—A screen of any shape that completely encircles the pipe to be protected. The shape of the screen prevents the screen itself from plugging.

Surface water—water from any source on the surface of the earth. This includes rivers which may flood into streets.

Sanitary Sewer—A sewer which carries wastes from indoor plumbing to a lateral line.

Combined Sewer System—A sewer system having a sewer line which carries both waste water and surface water to a sewage treatment plant. In combined sewers the water from each catch basin flows into a sanitary sewer lateral line.

The present invention provides a system for controlling the flow of surface water from catch basins into a combined sewer, particularly surface water entering into such combined sewers at flow rates which normally would cause overflow of combined sewers and basement flooding problems in buildings served by such combined sewers.

In one aspect, the control system of the present invention provides a process for eliminating the overflow and sewage back-up caused by surface water in combined sewers. Such a process comprises a plurality of steps. In one step, the maximum liquid flow capacity of the interceptor sewer of such a combined sewer system in terms of flow rate per preselected unit of time is determined approximately. As a practical matter, a reasonably accurate estimate of such maximum liquid flow capacity of the trunk line can be calculated from a knowledge of the combined sewer parameters. However, it is understood that in some combined sewer systems, particularly older types, the maximum liquid flow capacity of the interceptor sewer can only be accurately estimated by a combination of parameters which include an analysis of actual use data for an individual combined sewer system. In any event, the determination of maximum liquid flow capacity of the interceptor sewer for a combined sewer system is a matter of routine engineering well known to those skilled in the art.

In another step for practicing the process of this invention, one measures the maximum dry flow rate of sewage through such interceptor sewer of the combined sewer in terms of flow rate per preselected unit of time. Such value can be readily and simply obtained, as an engineering matter, from operating data routinely maintained for a combined sewer system by the operating personnel thereof. The calculating of such a value from such data is a matter of engineering routine well known to those of ordinary skill in the art. Rates of flow can be stated in terms of gallons per hour, in pounds per hour, or the like, as desired.

In a next step for the process of this invention, one subtracts from such maximum liquid flow capacity for the trunk line the maximum dry sewage flow rate for such trunk line to determine a flow rate which is representative of the maximum flow rate possible at which surface water can enter and flow through such interceptor sewer of the combined sewer system.

In another step, one determines the number of catch basins (and equivalent sources of surface water) which feed surface water, through lateral lines, into the interceptor sewer of the combined sewer system, and one estimates the maximum rate of flow per preselected unit of time which can be discharged through each individual catch basin into the interceptor sewer and still achieve a summation value for the total amount of surface water from all catch basins which is not greater than such maximum possible interceptor surface water flow rate. Preferably, this estimation for individual catch basins is made so that the total amount of surface water in terms of flow rate per preselected unit of time in the interceptor sewer is always slightly less than the maximum liquid flow capacity of the interceptor sewer of the combined sewer system, so that there is not only a safety margin (including a margin for increased future system dry sewage flow rate), but also the capacity to permit flow rates of rain water from individual preselected ones of catch basin in the system to exceed by some determinable amount a normal and predetermined flow rate for such street sewer, for reasons as will be hereinafter explained more fully. This estimation is particularly simple to make when all connecting pipes are reduced to the same size.

As a practical matter, because of the conventional engineering design considerations used in constructing a combined sewer system, individual catch basins typically have a water flow capacity therethrough which is naturally greatly in excess of an assigned flow rate therefor estimated in the manner just above described. Such an estimated maximum flow rate of liquid to be assigned to each individual catch basin in a combined sewer system can be determined by various procedures, such as by, assigning the same flow rate to each catch basin in the system, as by assigning a distinct and individually determined flow rate to catch basins in such system, or the like, as desired. Independently of the normal surface water flow rates through a street sewer at any given location, a number of factors can be taken into account if desired, which are essentially system parameters, such as location of a catch basin in relation to the entire system interceptor sewer thereof, interconnecting pipe sizes between a catch basin and the lateral lines, flow times of surface water between the catch basin entrance and the interceptor sewer, and the like.

Then, one adjusts the effective maximum flow rate of surface water through each catch basin to a value which is not greater than such estimated maximum surface water flow rate for each such catch basin. Techniques and means for accomplished such adjustment are described hereinbelow.

When it is not possible or practical for some reason or reasons associated with an individual situation, to calculate, or assign, or otherwise determine, a flow rate of water for an individual catch basin or even for some group, or all, of the catch basins of a given combined system, then one can use a modified process of the present invention wherein one more or less arbitrarily constricts or limits the maximum flow rate of surface water from the catch basin which can flow in a controlled manner to the interceptor sewer by employing water flow regulating means as herein illustrated at each individual street sewer, thereby to regulate the total amount of rain water entering into the interceptor sewer of a given combined sewer system. Such an arbitrary assignment procedure can be based upon empirical data or estimates, and is suitable for employment in a situation where, for example, a particularly serious flooding problem associated with a given combined sewer system, or some catch basins in the system, is involved which apparently cannot be accurately solved through an analysis of flow rates in various portions of the system, or at particular locations in the system. Sanitary engineers are well familiar with the conventional procedures which may be used for such an assignment procedure. In general, the measurement of various sewer system flow rates is conventional and does not as such constitute a part of the present invention.

Variations in the flow rates of water through individual catch basins can be made to occur by means of a submerged pump or the like to better accommodate individual situations and system needs to avoid flooding and pollution problems in using such an assignment procedure. Preferably, of course, there is no variation; the same size pipe is installed in every catch basin.

A preferred procedure for practicing the process of this invention is as follows:

(A) Disconnect all downspouts, sump pumps, and foot drains from the sanitary sewers.

(B) Calculate or determine from existing operating data the capacity of the interceptor sewer. If the flow is calculated from the pipe size be sure to subtract the area above the point where the sewer overflows. Subtract from the capacity 10% of the capacity for surface water to allow for seepage and pick holes in manhole covers.

(C) Divide the capacity for surface water from catch basins by the number of catch basins contributing surface water to the interceptor sewer.

(D) Calculate the reduced size pipe to be installed in all catch basins in order to attain the desired flow rate.

(E) Thread the reduced pipe, and install it. Install the same size in each catch basin.

(F) Check all catch basins after a rainstorm heavy enough to cause overflow and determine which areas drained through catch basins have street flooding problems attributable to the constriction of the catch basin outlet. Install pumps in these catch basins. Protect pumps and pipes against plugging by means of box screens or the like.

(G) Check overflow points to determine whether the interceptor still overflows.

(H) If some flooding still occurs, install calibrated valves in catch basins which have no problem and reduce the flow from these catch basins until overflow stops. These valves can also be adjusted as dry flow increases due to, for example, changes from single family units to multiple family units.

(I) If the combined sewer system has any surface water drains which empty directly into the lateral line, control of flow may be achieved by use of a collector as described herein.

Calculations can probably be eliminated or minimized by consulting sewage plant records.

All downspouts, sump pumps and foot drains must preferably be eliminated otherwise any calculations are invalid.

In my preferred procedure all of the catch basins are in one class and the same unit is installed in each of them. Where drainage after a storm is a problem, a pump is installed.

In accordance with the teachings of the present invention the flow of surface water from the mouth of a catch basin into the lateral line is controlled by adjusting the size of one or more of the openings between the mouth of the catch basin and the intervening passageway between the catch basin mouth and the lateral line in a catch basin. Thus, one can adjust the size of the openings into the lateral line by adjusting the size of the opening immediately below the mouth of the catch basin, by adjusting the effective cross sectional area of the pipe interconnecting catch basin and the lateral line by some combination thereof, or the like. The smallest opening, or the smallest pipe diameter, determines the flow rate of surface water from the mouth of an individual catch basin to the lateral line. Thus, it is not necessary, for example, to change the cross sectional area of each region between the mouth of a sewer system and a lateral line, and only one such cross sectional area adjustment is necessary, though two or more thereof may be used because of available equipment, maintenance considerations, combined sewer system lay-out, and the like, in an individual situation, as desired by a particular user of this invention.

For instance, the maximum dry flow through an interceptor sewer which receives surface water from 100 catch basins is 105,424 gallons per hour. The average maximum flow through this sewer is 345,024 gallons per hour. By subtracting the dry flow discharge from the maximum discharge without overflow, it is found that the maximum allowable discharge of surface water into the sewer is 239,600 gallons per hour. Each catch basin in the system can discharge 2396 gallons of water per hour into its lateral line. Since a two inch pipe discharges 2396 gallons of water per hour, two inch pipes are installed in each catch basin.

For example, referring to FIG. 1, there is seen a catch basin 10 having a mouth 11 which is protected by a grating 12 at the upper end or mouth 11 of a catch basin 13. Grating 12 rests upon an inturned flange 14 of frame 15. Catch basin 13 facilitates the removal of grit and silt which tend to collect in the invert region 16 at the bottom of catch basin 13.

The bottom and sides of invert region 16 are defined by a base 17 which is conveniently formed of masonry, brick, pre-cast reinforced concrete, or the like. Catch basin here illustratively has a cross-sectionally circular configuration but other configurations may be employed. Resting upon the shoulder 18 and adjacent groove 19 about the upper end of base 17 is a riser 21 which can be formed similarly to the manner in which base 17 is formed. Riser 17 is sometimes referred to as the barrel of catch basin 13. Resting upon the shoulder 22 and the groove 19 of riser 21 is a cone 24 which can be formed similarly to the base 17. The side walls of cone 24 here illustratively define a downwardly opening taper which is not symmetrical to the axis of cone 24, but other configurations may be employed. Circumferentially about the top of cone 24 rests frame 15. Spacing between frame 15 and the top of cone 24 is regulatable by any conventional means, such as by one, two or three courses of brick masonry, or of reinforced concrete grating rings, or the like, so that the position of grating 12 is adjustable relative to a particular grade 25.

Somewhat above the inside bottom of base 17 (so as to define an invert region 16), an aperture in the side wall of base 17 is joined to a first outlet pipe 27, which may be constructed of tile or the like, and which extends laterally into an appropriate conventional interconnection with another outlet pipe 28 that, in turn, interconnects with a trunk line (not shown but conventional) in a combined sewer system. Outlet pipe 27 generally extends horizontally but at a predetermined pitch or slope downwardly from base 17. Pipe 28 is here illustratively joined to another outlet pipe 29 from some other catch basin (not detailed).

In order to control the maximum flow rate of water from mouth 12 into pipe 28, the mouth 31 of pipe 27 has inset thereinto a bushing whose interior aperture or channel 33 is sized so as to permit a predetermined maximum flow rate of water to pass therethrough. The cross sectional size of channel 33 is determined in any given instance by preferably a predetermined maximum flow rate of water into pipe 27 as hereinabove described for reasons of controlling the total amount of water entering a lateral line in the combined sewer system of which catch basin 13 is a part.

In order to sealingly engage the circumferential outside walls of bushing 32 with the adjacent inside walls of pipe 27, gasket rings 34 are positioned therebetween.

In place of bushing 32 and gasket rings 34 one can employ a cap 36, as illustrated in FIG. 5, as an interposed constricting means in a catch basin. Cap 26 is provided with a centrally positioned aperture 37 which longitudinally extends in relation to an associated pipe 24'. A cap 36 can be inserted into a pipe 27' by a worker based in invert region 16'. A resilient gasketing material (not shown) may be employed to sealingly engage the radially outwardly extending flange portion 38 of cap 36 against the mouth region of pipe 27'.

Another form of constricting means for an outlet pipe is illustrated in FIG. 6 wherein a cap assembly 43 is illustrated. This cap assembly is provided with a duct 44 which longitudinally extends in relation to the associated outlet pipe 27'' like cap 36, cap assembly 43 is inserted into the outlet pipe 27 in a similar manner. One advantage for a cap assembly 43 lies in the fact that the pipe 44 can be constructed so as to cooperatively act with a face plate 46 which is secured by welding or the like to a sleeve 47. In this way simple construction techniques make possible a variety of interchangeable components in the fabrication of cap assemblies such as 43 since it is a relatively simple matter to weld together different diameters of pipes 44 and sleeves 47 to a given face plate 46.

In FIGS. 2, 5, 6 and 7 components which are analogous or similar to the components identified in FIG. 1 are similarly numbered but with the addition of prime marks thereto.

Referring to FIG. 2 there is seen a constricting means adapted for use in the present invention which is mounted across a frame 15', and supported from the same flange 14' used to support the grating 12 of a catch basin 13', such constricting means here being a funnel-shaped member 48. Member 48 has tapered side walls which are here illustratively generally cross sectionally circular. Funnel-shaped member 48 thus has an upper wide mouth 49 and a lower narrow mouth 51. The cross sectional dimensions of mouth 49 are approximately equal to those of the mouth of the manhole 13' in the region of flange 14' thereof. The member 48 is provided with a circumferentially outwardly extending shoulder 52 which acts as a suspending means that is adapted to be received against flange 14' so as to support thereby the member 48 in the manhole 13'.

The narrow mouth 51 of cone shaped or funnel shaped member 48 has a cross sectional area such that the flow rate of water therefrom is controlled at a predeterminable desired maximum value as hereinabove described. If desired, sealing means (not shown) can be interposed between shoulder 52 and flange 14' so as to provide a sealing engagement between frame 15' and funnel shaped member 48. In order to provide funnel shaped member 48 with the capacity to handle and provide different rain water flow rates, a plurality of sleeves, such as sleeve 53 (shown in dotted lines) may be slipped into place inside funnel shaped member 48. The walls of sleeve 53 are tapered so as to make a sealing engagement with the adjacent walls of the funnel shaped member 48, but gasketing material (not shown) may be used to achieve a sealing engagement therebetween if desired. The cross sectional mouth region 54 of a sleeve 53 is so chosen as to provide a predeterminable flow rate of rain water or the like therethrough. By utilizing a family of sleeves 53 a single funnel shaped member 48 can be used to achieve a relatively wide range of flow rates.

Referring to FIG. 3 there is seen illustrated another form catch basin herein designated in its entirety by the numeral 56. Side and bottom walls of construction 56 are fabricated here of precast reinforced concrete but any conventional material of construction can be used if desired. Construction 56 is located adjacent a street curb 57 and incorporates thereinto a frame 58, formed of cast metal or the like, which has two openings defined therein, one an opening 59 located beneath the overhang of curb 57 and the other opening 61 being located in adjacent spaced relationship to the curb 57. Opening 61 is provided with a cover 62 which rests about its peripheral edge portions upon a flange 63 integrally formed with the frame 58 and inwardly extending about the opening 61. An aperture 64 formed near the bottom of construction 56 is sealingly interconnected with a pipe 66 which has functionally engaged therewith a valve assembly 67 that is located adjacent drain construction 56. Valve 67 is adjustable so as to vary the flow rate of liquid through pipe 66 leaving drain construction 56. Valve 67 is provided with a stem 68 which when axially turned by handle 69 at the upper end thereof results in movements which enlarge or constrict the cross sectional area of pipe 66 to regulate the maximum flow rate of water therethrough. The handle 69 is contained and located in a housing 70 which is provided with a hinged grill 71 located approximately along grade 72 thus one can by raising grill 71 adjust valve 67 by rotating handle 69.

Figure 4:
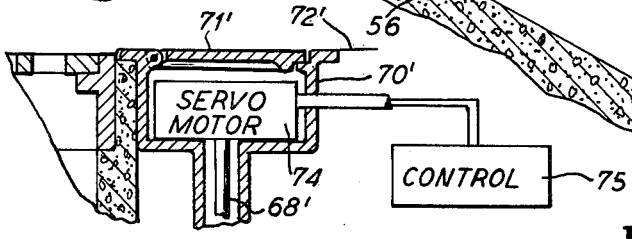
FIG. 4 is a fragmentary view illustrating a valve control means which is remotely operated for the regulation of a valve such as is utilized in the embodiment shown in FIG. 3.

To remotely adjust valve 67, an arrangement such as shown in FIG. 4 may be employed if desired. Here, the valve stem 68' is interconnected with a remotely controllable mechanism 74 which can be a servo motor or the like as those skilled in the art will appreciate. Such a valve regulator 74 can itself be operated from some predetermined remote location either manually or automatically, as by a controller 75. In FIG. 4, parts thereof which are similar to parts of FIG. 3 are correspondingly numbered but with the addition of prime marks thereto for convenience. Valve 67 may be conventional in construction.

Referring to FIG. 10, there is seen diagramatically one embodiment of a combined sewer system of the type adapted for use in the practice of the present invention, such system being designated in its entirety by the numeral 120. System 120 employs a plurality of catch basins 121. Each catch basin 121 collects and discharges surface water from a bottom region thereof through a connecting pipe 122. In turn, pipe 122 interconnects with a lateral line 123, and the individual lateral lines 123, in turn, discharge into a trunk line 124 of the sewer system 120. The effluent from trunk line 124 discharges into the interceptor pipe 125 which leads to a sewage treatment plant (not detailed). In system 120, inputs such as from downspouts, sump pump, foot drains and the like, which formerly fed surface water into system 120 through feed lines, such as pipes 126, are disconnected.

Figure 8:
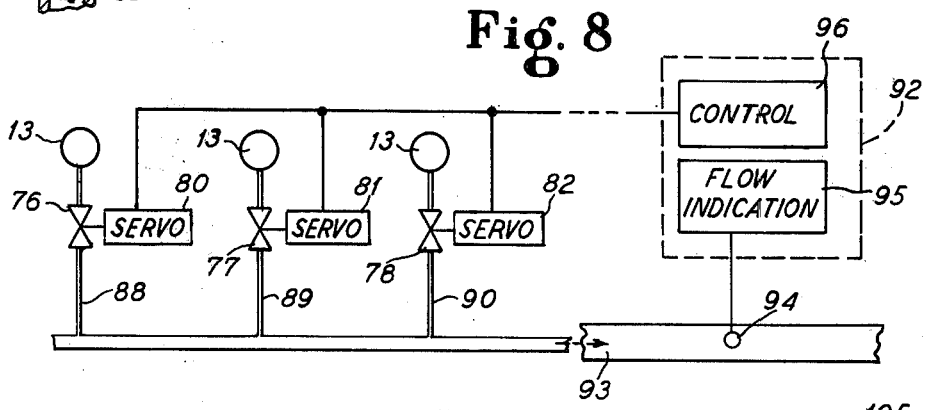
FIG. 8 shows one embodiment of a control system suitable for use in the practice of the present invention.

Referring to FIG. 8 there is seen one embodiment of the semi-automatic arrangement for practicing in one mode the present invention. Here, a series of variable valves designated as valves 76, 77 and 78 for purposes of illustration, are utilized, each of the valves 76, 77 and 78 being associated with an outlet pipe in the manner, for example, that valve 67 is associated with pipe 66. Each of the valves has respectively associated therewith a servo motor designated individually illustratively as servo motors 80, 81 and 82, respectively. In FIG. 8, each sewer designated, respectively, by the numerals 84, 85, and 86 and its associated discharge or outlet pipe by the respective numerals 88, 89 and 90, respectively. The switching assemblies for operating the individual servo motors 80, 81 and 82 are located remotely at a control center 92. The trunk line 93 into which rain water discharged through pipes 88, 90 and 91 is received is provided with a flow sensor 94 which may be a transducer or the like, whose output is received in the control center 92 and conveniently displayed by a flow indicator 95 or the like. Whenever flow indicator 95 (which may be a meter, etc.), indicates that the flow of water through the trunk line 93 is about to exceed its maximum capacity, an operator at control center 92 can activate the control 96 for the servo motors 80, 81 and 82 so as to reduce the cross sectional area of the respective pipes 88, 89 and 90. In the embodiment shown, the servo motors 80, 81 and 82 operate together and each is adapted to enlarge or reduce the cross sectional area of its associated pipe 88, 89 and 90 by an equal amount in response to activation of the control 96. The valves 76, 77 and 78 are maintained in a normally fully open position and are each partially closed by operation of control 96 functioning through servo motors 80, 81 and 82 to an equal extent so that the total amount of surface water entering the lateral line 93 is always maintainable below maximum capacity thus flooding and sewage pollution problems caused by excess surface water are avoided.

Figure 9:
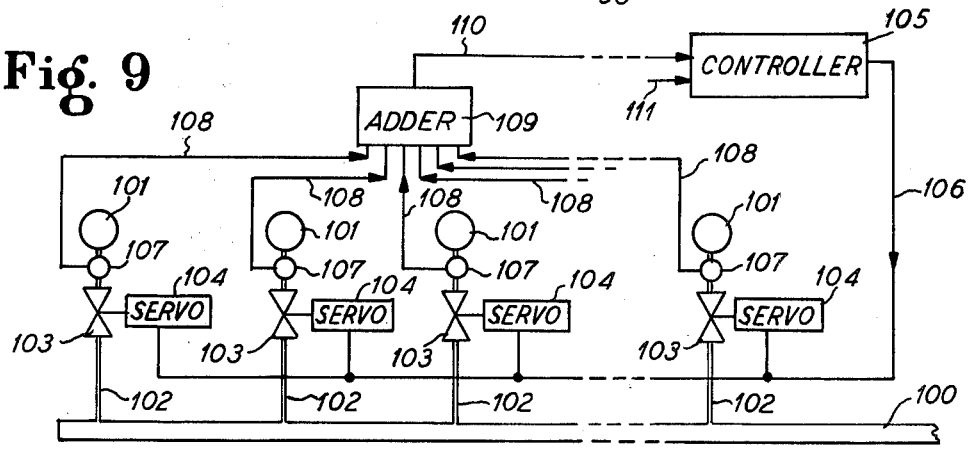
FIG. 9 is a view similar to FIG. 8 but showing an embodiment of an automated control system.

An automatic arrangement is shown in FIG. 9. Here, a trunk line 100 in a combined sewer system receives surface water through each of a plurality of street sewers 101 via respective associated outlet pipes 102, each such pipe 102 being provided with a variable valve assembly 103. Each valve 103 is controlled by a servo motor 104, respectively, with all such servo motors 104 being controlled from a controlled 105 via line 106. Each pipe 102 is provided with a flow sensor 107, such as a transducer or the like, each flow sensor 107 being adapted to meter the flow rate of water entering its associated pipe 102 from sewer 101. Each flow sensor is adapted to produce a signal representative of the flow it senses in its associated pipe 102 and this signal is conveyed from each flow sensor 107 via an associated line 108 to an adder 109 which is adapted to accumulate and add together the respective signals received from the individual lines 108 thereby to provide a measurement of the approximate total flow rate of rain water at any given instant in time which is being fed by the sewers 101 to the trunk line 100. The output from adder 109 is converted into a signal which is representative of such accumulation and this addition signal is fed via a line 110 to the controller 105. In controller 105, the signal from line 110 is compared to a signal fed to controller 105 via, for example, line 111. The signal fed to controller 105 from line 111 is representative of the maximum possible or desired flow rate achievable or to be achieved in the trunk line 100. Whenever the difference between the signals being fed to controller 105 from respective lines 110 and 111 reaches some predetermined or assigned negligible value, the controller 195 then senses, in effect, that capacity conditions have been reached or are being approached in the trunk line 100 and the controller 105 is then adjusted so as to emit a control signal from line 106 to each of the servo motors 104 which operates the valves 103 thereby to limit the amount of water entering the trunk line 100, the operation of the valves 103 thus being analogous to the valves 76, 77, and 78 earlier above described in reference to FIG. 8 herein.

The following Table 1 illustrates the effect of varying pipe size on water flow rates:

Table I

| Diameter of Pipe in inches | Rate of Flow in gallons per hour | Rate of Flow in pounds per hour |
|---|---|---|
| 6 | 21564 | 180,000 |
| 4 | 9584 | 80,000 |
| 3 | 5391 | 45,000 |
| 2 | 2396 | 20,000 |
| 1 | 599 | 5,000 |

Thus, relatively small changes in pipe size dramatically and effectively are able to control the flow rates of water from individual catch basins into the trunk line of a given combined sewer system.

It is commonly believed that the construction of the catch basin outlet would cause streets to flood. For this reason, so far as is known, no one has ever suggested using the method of this invention for the elimination of overflow of combined sewers. While constriction of the outlet will improve drainage, a smaller pipe is more likely to clog. To eliminate this possibility, a constricted outlet is preferably protected. A preferred protective means comprises a screen. In order that such a screen will not become plugged, it is preferably designed to surround, rather than be placed merely on the end of a pipe.

For example, referring to FIG. 7, there is seen a screen assembly which is suitable for use in this invention designated in its entirety by the numeral 111. Screen assembly is seen functionally associated with pipe 27''' which is functionally associated with (coupled to) the base 17''' of a catch basin 10''' (fragmentarily shown). Circumferential inner surfaces of pipe 27'' adjacent the end thereof are provided with threads 112. Such threads 112 can be provided by any convenient means, such as, as shown, by means of an insert sleeve 113 inserted into the mouth of pipe 27' in base 17''' and retained there by any convenient means, such as by cement, epoxy adhesive, or the like, as desired (not detailed).

The screen assembly 111 includes a pipe 114 whose outside diameter is smaller than the inside diameter of pipe 27'. The open or terminal end of pipe 114 is threaded with threads 114A which are adapted to make mating threading engagement with threads 112 so as to engage the pipe 114 with pipe 27'''. The opposite end region 116 of pipe 114 has fitted thereover a cylindrically shaped box screen 115. The screen 115 is so constructed as to make generally sealing engagement with side wall portions of pipe 114 in region 116. Thus, water entering exterior surfaces of screen 115 can travel through screen 115 and enter the mouth 116A of pipe 114. The porosity of the screen 115 is preferably adjusted so as to resist passage therethrough of sticks, leaves, gravel, and the like while permitting sand particles, and the like under about 0.1 millimeter to travel therethrough without plugging, preferably, box screen 115. Screen 115 is of conventional construction.

The principal causes of street flooding by or involving catch basins are:

1. The grating which covers the catch basin is plugged by grass clippings, leaves, or other debris.
2. Too many catch basins are attached to the lateral line or to the storm sewer. Table (II) shows the number catch basins which can be attached to a 24 inch sewer for various size catch basin outlets.

Table II

The Number Of Catch Basins Which Can Be Accomodated By A 24 Inch Sewer Line

| Size of Catch Basin Outlet in inches | Maximum Flow Gallons/Hour | Maximum Number of Catch Basins |
|---|---|---|
| 12 | 86,256 | 3 |
| 10 | 59,900 | 6 |
| 8 | 38,336 | 9 |
| 6 | 21,564 | 16 |
| 4 | 9,584 | 36 |
| 3 | 5.391 | 64 |
| 2 | 2,396 | 144 |

When the number of catch basins exceeds the numbers that can be accommodated in a given system, the storm sewer or the combined sewer will back up into streets. This type of flooding occurs in areas where the street level is lower than the level of the water in portions of the sewer line located at higher elevations. The back up continues until the water level at higher elevations recedes.

I recognize that overflow cannot be eliminated unless the following sources are disconnected from the sanitary sewers: (1) Downspounts; (2) Sump pumps; and (3) Foot drains. The extent of this contribution to the overflow problem is illustrated in the following example: If two inches of rain fall on the roof one house, whose downspouts are attached to a sanitary sewer, and whose roof area is 2000 square feet, approximately 2500 gallons of water enter the sewer system. If 500 houses of this roof have downspouts connected to the same sanitary sewer 1,246,750 gallons of water will enter the sewer system. If this amount of rain falls in one hour or one inch of rain falls in one half hour, a sewer less than 45 inches in diameter would overflow from downspout discharge alone.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth in the hereto-appended claims.

I claim:

1. A process for preventing overflow and sewage back-up by surface water in a combined sewer system having a plurality of catch basins comprising the steps of:

(A) assigning a maximum surface water flow rate from each catch basin in such combined sewer system, and (B) adjusting the effective maximum flow rate of surface water through each catch basin to a value which is not greater than said assigned maximum surface water flow rate for the individual catch basin.

2. A process for preventing overflow and sewage back-up by surface water in a combined sewer system having an interceptor pipe to which a plurality of catch basins are functionally connected by intermediate sewer lines comprising the steps of:

(A) determining the maximum liquid flow capacity of such interceptor pipe in terms of flow rate per preselected unit of time, (B) determining the maximum dry flow rate of sewage through such interceptor pipe in terms of flow rate per said predetermined time unit, (C) subtracting from said maximum liquid flow capacity said maximum dry sewage flow rate to determine the maximum surface water flow rate possible through said trunk line, (D) estimating the maximum surface water rate of flow per said preselected unit of time which can be discharged through each such catch basin of such combined sewer system and still achieve a summation value for the total surface water flow rate from all such catch basins which is slightly less than said maximum surface water flow rate for said interceptor pipe, and (E) adjusting the effective maximum flow rate of surface water through each catch basin to a value which is not greater than said estimated maximum surface water flow rate for each such system catch basin.

3. The process of claim 2 wherein said estimating is accomplished by dividing the capacity of the interceptor pipe by the number of catch basins which constitute surface water thereto.

4. The process of claim 2 wherein a pump is installed in each catch basin whose drainage is impaired.

5. A process for controlling the flow of surface water through an interceptor of a combined sewer system which has a plurality of individual catch basins functionally associated therewith and adapted to receive thereinto surface water, said process comprising the steps of (A) providing each member of a predetermined class of catch basin in such plurality of catch basins with variable regulator means for regulating the maximum flow rate of surface water therethrough which regulator means are operable from a common general location that is relatively remotedly located with respect thereto, (B) providing each said member of said predetermined class with sensing means for sensing representatively the flow rate at which surface water moves therethrough which sensing means are sensible at said common remote location, (C) varying said variable regulator means to control the maximum flow rate of surface water passing through their respective associated said members of said predetermined class responsively to the flow rates of surface sensed by said sensing means thereby to maintain said flow rates below predetermined maximum values.

6. The process of claim 5 wherein the total accumulated maximum flow rate surface water from the sum of the individual flow rates of surface water of the members of said predetermined class of catch basin is determined and is maintined by said varying at a value which is below a predetermined maximum surface water flow rate in said trunk line.

7. The process of claim 5 wherein said process is automatically conducted.

8. The process of claim 6 wherein said process is automatically conducted.

9. Apparatus for controlling the flow of surface water through interceptor of a combined sewer system which has a plurality of individual catch basin submits functionally associated therewith and adapted to receive thereinto surface water, said apparatus comprising:

(A) variable regulator means for regulating the maximum flow rate of surface water through each member of a predetermined class of catch basin subunits in such plurality of catch basin subunits, (B) sensing means for sensing the flow rate at which surface water moves through each member of said predetermined class, including means for generating an instantaneous signal representative of such flow rate, and first conveying means for conveying said signal to a location remote relative to said sensing means, and (C) operating means for operating each one of said variable regulator means for said remote location and second conveying means interconnecting said operating means with each of said variable regular means.

10. The apparatus of claim 9 further including control means for receiving said signals from said first conveying means, for comparing said signals to a reference signal representative of a predetermined maximum flow rate through each respective one of said predetermined class members, for generating an output signal representative of any difference between said signal and said reference signal, and for conveying said output signal to said operating means, said operating means being responsive to said output signal, said output signal thus operating said operating means for said variable regulator means.

11. The apparatus of claim 9 further including accumulation means for adding together the respective signals received from individual ones of said sensing means and for generating an addition signal representative thereof, first control means for receiving said addition signal, for comparing said addition signal to a reference signal representative of a predetermined maximum flow rate through interceptor and for generating a difference signal representative of any difference between said addition signal and said reference signal and second control means for receiving said difference signal, for generating a plurality of operating signals representative thereof, there being one such operating signal for each respective one of said operating means, for delivering said operating signals to said operating means, said operating signals only being generated by said second control means when said difference signal exceeds the value of said reference signal.

12. A process for preventing overflow and sewage back-up by surface water in a combined sewer system having an interceptor pipe to which a plurality of catch basins are functionally connected by intermediate sewer lines comprising the steps of:

(A) disconnecting all downspouts, sump pumps, and foot drains from the sewer lines.

(B) determining from existing operating data the capacity flow rate of the interceptor sewer and subtracting from such capacity flow rate 10 % of the flow rate capacity for surface water from catch basins to allow for seepage and pick holes in manhole covers, (C) dividing the flow rate capacity for surface water from catch basins by the number of catch basins contributing surface water to said interceptor sewer, (D) calculating a reduced size pipe to be installed in all catch basins in order to attain a desired flow rate from each catch basin, (E) installing such reduced size pipe functionally in each catch basin, (F) checking all catch basins after a rainstorm heavy enough to cause overflow and determining which areas that drain through particular catch basins of any have street flooding problems attributable to such reduced size pipe installed in those particular catch basins and installing pumps in these catch basins having capacities calculated to relieve such localized area overlows, such pumps being protected against plugging, (G) checking such localized previously determined overflow areas to determine whether said interceptor sewer is operating at such capacity flow rate, (H) if some flooding still occurs, installing calibrated valves in selected catch basins which have no localized area overflow problem and reducing the flow from these catch basins until overflow stops at such previously determined overflow areas, and (I) if the combined sewer system has any surface water drains which empty directly into a system lateral line, controlling flow of such drains thereinto.

* * * * *